US005498133A

United States Patent [19]

Lee

[11] Patent Number: 5,498,133

[45] Date of Patent: Mar. 12, 1996

[54] PRESSURE REGULATED FILM COOLING

[75] Inventor: Ching-Pang Lee, Cincinnati, Ohio

[73] Assignee: General Electric Company, Cincinnati, Ohio

[21] Appl. No.: 471,291

[22] Filed: Jun. 6, 1995

[51] Int. Cl.[6] ..... F01O 5/18

[52] U.S. Cl. ..... 416/97 R

[58] Field of Search ..... 415/115; 416/96 R, 416/96 A, 97 R, 97 A

[56] References Cited

U.S. PATENT DOCUMENTS

| | | | |
|---|---|---|---|
| 3,934,322 | 1/1976 | Hauser et al. . | |
| 4,183,716 | 1/1980 | Takahara et al. . | |
| 4,601,638 | 7/1986 | Hill et al. . | |
| 4,770,608 | 9/1988 | Anderson et al. . | |
| 5,062,768 | 11/1991 | Marriage . | |
| 5,370,499 | 12/1994 | Lee | 416/97 R |

*Primary Examiner*—Edward K. Look
*Assistant Examiner*—Christopher Verdier
*Attorney, Agent, or Firm*—Andrew C. Hess; Patrick R. Scanlon

[57] ABSTRACT

A gas turbine engine airfoil includes first and second sidewalls joined together at opposite leading and trailing edges and spaced apart from each other to define at least one internal flow channel for channeling cooling air therein. A plenum is defined by an inner surface of the first sidewall and by an internal wall adjoining the flow channel. A pair of injection holes extend through the internal wall to feed the cooling air into the plenum. A plurality of film cooling holes extend through the first sidewall in flow communication with the plenum for channeling the cooling air in a film along an outer surface of the first sidewall to effect film cooling. The injection holes are aligned to converge toward each other so that cooling air jets discharged therefrom collide with each other inside the plenum to reduce pressure thereof. This regulates the pressure across the film cooling holes to improve film cooling.

11 Claims, 2 Drawing Sheets

PRESSURE REGULATED FILM COOLING

BACKGROUND OF THE INVENTION

The present invention relates generally to gas turbine engines, and, more specifically, to the film cooling of turbine rotor blades and vanes.

A gas turbine engine includes a compressor for compressing air which is channeled to a combustor wherein it is mixed with fuel and ignited for generating combustion gases. The combustion gases flow downstream through one or more turbines which extract energy therefrom for powering the compressor and producing output power. Turbine rotor blades and stationary nozzle vanes found in the high pressure turbine disposed immediately downstream from the combustor are typically supplied with a portion of compressed air bled from the compressor for cooling these components to effect a useful life thereof. Both the rotor blades and stator vanes have airfoils including pressure and suction sides over which the combustion gases flow during operation. The airfoils typically include serpentine cooling passages therein in which the cooling bleed air is channeled and discharged from the airfoils through film cooling holes spread over the outer surfaces thereof.

In film cooling, the cooling air must be channeled through the airfoils with a suitably high pressure to prevent backflow ingestion of the hot combustion gases through the film cooling holes, while at the same time avoiding excessive pressure drop across the film cooling holes which would tend to separate the film from the outer surface of the airfoils which would substantially degrade film cooling effectiveness. Film cooling art is crowded with various film cooling hole designs which attempt to effect the best film cooling possible with minimum film separation tendency and a suitable backflow margin to prevent ingestion of the hot combustion gases. The substantial number of prior art film cooling designs clearly evidence the difficulty in achieving this compromise, with minor variations in film cooling geometry providing significant performance changes in an ongoing attempt to maximize cooling efficiency while reducing the use of parasitic bleed air.

SUMMARY OF THE INVENTION

A gas turbine engine airfoil includes first and second sidewalls joined together at opposite leading and trailing edges and spaced apart from each other to define at least one internal flow channel for channeling cooling air therein. A plenum is defined by an inner surface of the first sidewall and by an internal wall adjoining the flow channel. A pair of injection holes extend through the internal wall to feed the cooling air into the plenum. A plurality of film cooling holes extend through the first sidewall in flow communication with the plenum for channeling the cooling air in a film along an outer surface of the first sidewall to effect film cooling. The injection holes are aligned to converge toward each other so that cooling air jets discharged therefrom collide with each other inside the plenum to reduce pressure thereof. This regulates the pressure across the film cooling holes to improve film cooling.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings In which.

DESCRIPTION OF THE PREFERRED EMBODIMENT(S)

Figure 1:
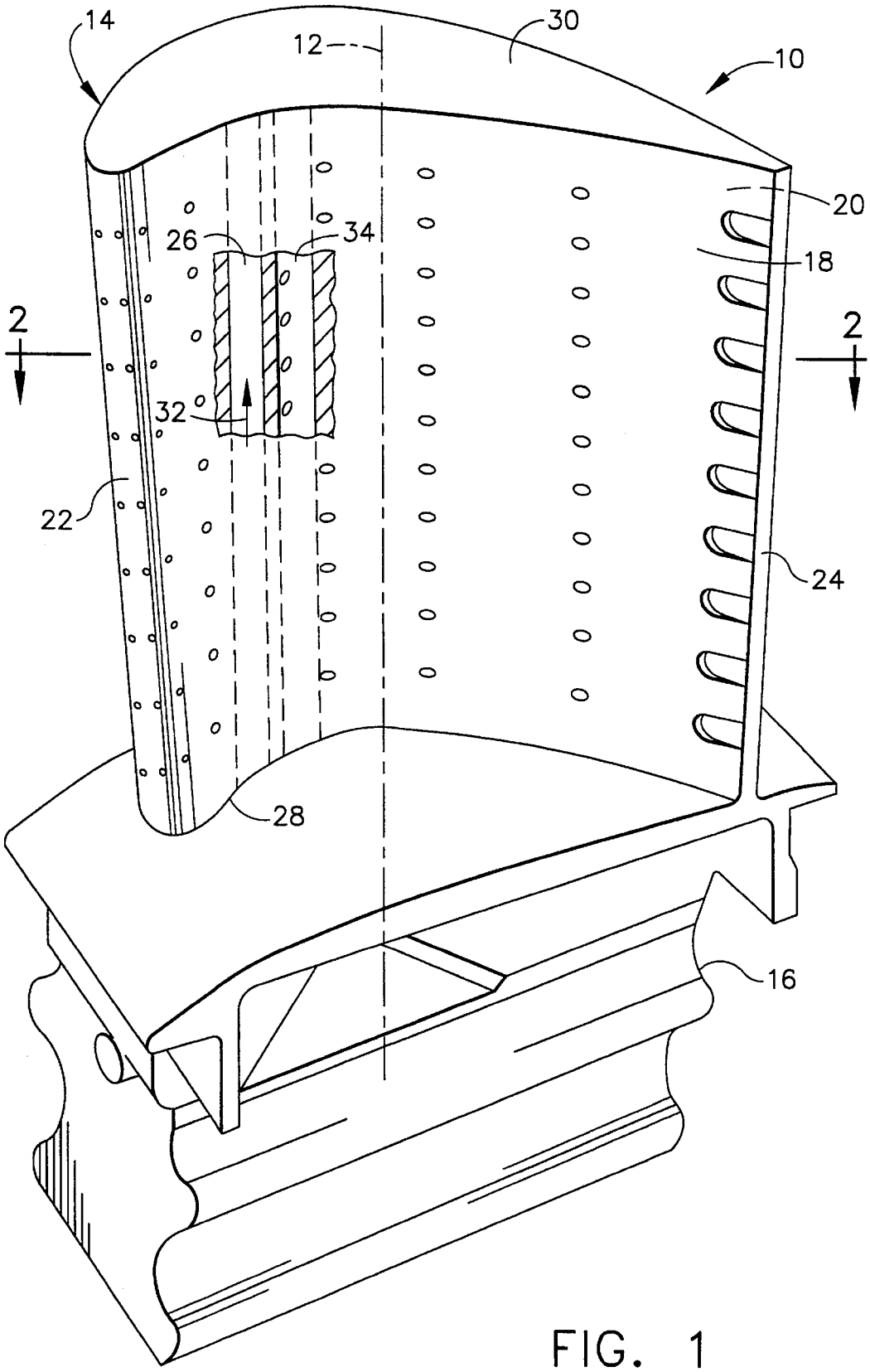
FIG. 1 is a perspective, partly cut away, view of a gas turbine engine turbine rotor blade having an airfoil with pressure regulated film cooling in accordance with one embodiment of the present invention.

Illustrated in FIG. 1 is an exemplary gas turbine engine turbine rotor blade 10 which is representative of one of many in a row of blades which extend radially outwardly from a centerline axis of the engine along a radial or longitudinal axis 12. The blade 10 includes an airfoil 14 over which hot combustion gases flow during operation. The airfoil 14 is mounted to a rotor disk (not shown) by a conventional integral dovetail 16. The airfoil 14 is cooled in accordance with the present invention, and although the airfoil 14 is shown as part of a rotor blade 10, it is also representative of stationary turbine nozzle vanes which may be similarly cooled in accordance with the present invention.

Figure 2:
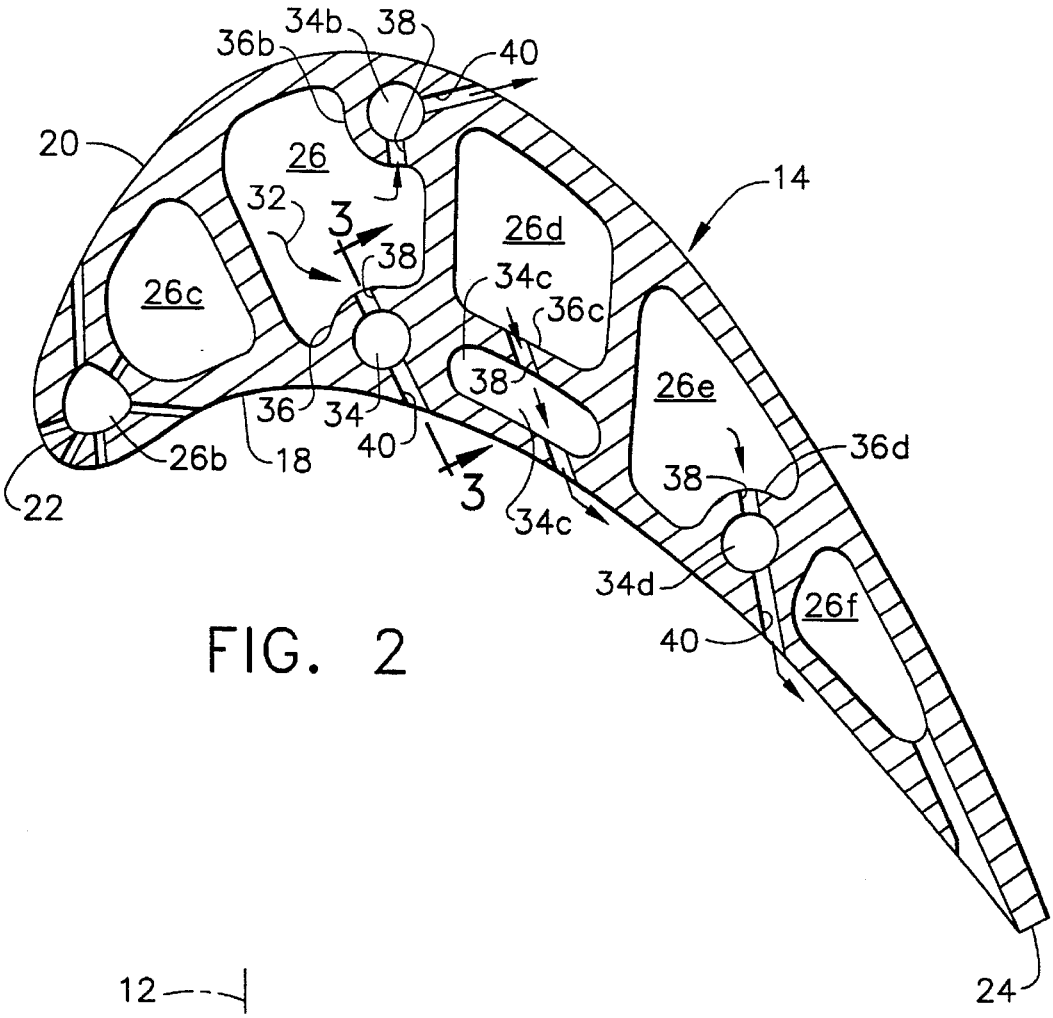
FIG. 2 is a radial sectional view through the airfoil illustrated in FIG. 1 and taken along line 2—2.

As shown in FIGS. 1 and 2, the airfoil 14 includes a first or pressure sidewall 18 and a second or suction sidewall 20 which are integrally joined together at opposite leading and trailing edges 22, 24. The first and second sidewalls 18, 20 are spaced apart from each other between the leading and trailing edges 22, 24 to define at least one internal flow channel 26 extending longitudinally or radially from a root 28 to a tip 30 of the airfoil 14 for channeling compressor bleed air or cooling air 32 therein to cool the airfoil 14. As shown in FIG. 2, this exemplary embodiment of the airfoil 14 includes five additional flow channels 26*b,c,d,e,f* which are conventionally interconnected with each other to form one or more continuous serpentine flow passages through which the cooling air 32 is channeled in a conventional fashion.

In accordance with the present invention, an enclosed cavity or plenum 34 is defined by an inner surface of the first sidewall 18 and a corresponding internal wall 36 which extends longitudinally or radially along the first sidewall 18 and adjoins the flow channel 26. Additional plenums 34*b,c,d* are also disclosed in the FIG. 2 embodiment and defined between respective inner surfaces of the first or second sidewalls 18, 20 and corresponding internal walls 36*b,c,d*. The various plenums 34 may be defined along either or both of the first and second sidewalls 18, 20 as desired.

Figure 3:
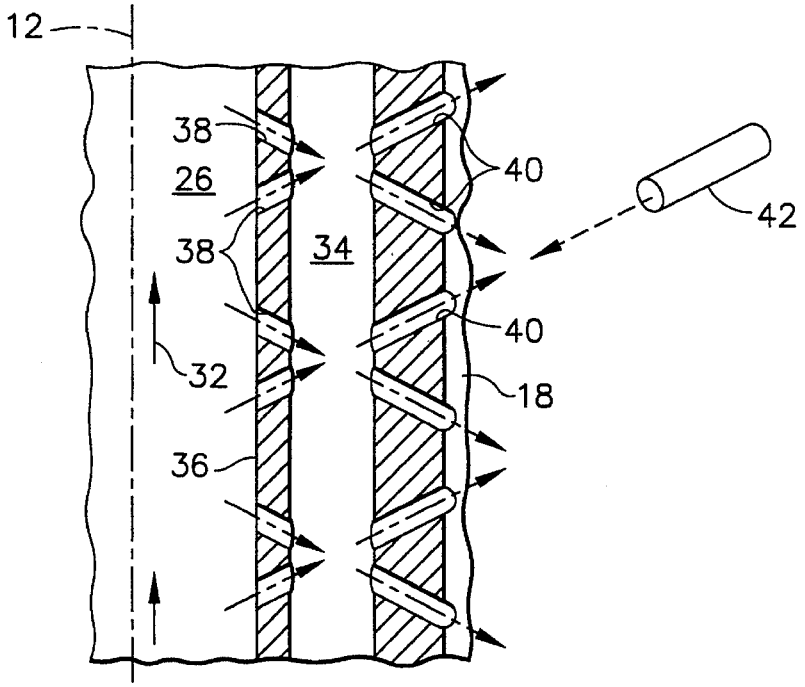
FIG. 3 is a longitudinal sectional view of a portion of the airfoil illustrated in FIG. 2 and taken along line 3—3.

Referring to both FIGS. 2 and 3, a plurality of pairs of metering or injection holes 38 extend laterally through the internal wall 36 to feed the cooling air 32 into the plenum 34. A plurality of conventional film cooling holes 40 which may take any conventional configuration extend laterally through the first sidewall 18 in flow communication with the plenum 34 for channeling the cooling air 32 in a film along an outer surface of the first sidewall 18 to effect film cooling in a conventional known manner.

In accordance with the present invention as illustrated in FIG. 3, the injection holes 38 are aligned relative to each other to converge toward each other so that cooling air jets are discharged therefrom and first collide with each other inside the plenum 34 to reduce the dynamic pressure thereof. Since the cooling air 32 must be channeled through the several flow channels 26 in the airfoil 14 it must initially have a suitably high pressure to ensure discharge of the cooling air from the film cooling holes 40 with a suitable backflow margin for preventing ingestion of hot combustion gases into the airfoil 14 during operation. In order to selectively regulate or reduce the pressure of the cooling air 32 between the various flow channels 26 and film cooling holes communicating therewith, the various plenums 34 and injection holes 38 are provided to effect enhanced pressure regulation which can be tailored for each local area within the airfoil 14.

As shown in FIG. 3 for example, the cooling air 32 initially passes longitudinally in the flow channel 26 and is diverted laterally into the injection holes 38 which initially provide a metering and pressure reduction function. The cooling air 32 is discharged into the plenum 34 as jets from the injection holes 38 which jets collide with each other in the plenum 34. The collision of the jets creates turbulence and reduces the pressure of the cooling air 32 as well as increases the convective heat transfer within the plenum 34 itself. The pressure reduced cooling air 32 is then metered through the several film cooling holes 40 wherein its pressure is further reduced to a level to ensure the formation of a film cooling layer having a reduced tendency to separate or blow off from the outer surface of the airfoil 14. The diameters or sizes of the injection holes 38 and film cooling holes 40 may be determined for each application to tailor the desired pressure regulation and, the relative size of the plenum 34 and the intersecting cooling air jets therein may also be tailored to achieve desired overall pressure regulation depending on the particular location around the surface of the first and second sidewalls 18, 20 at which the film cooling holes are located.

As shown in FIG. 3, each of the injection holes 38 has an inlet disposed in flow communication with the flow channel 26, and an outlet disposed in flow communication with the plenum 34, with the several inlets being radially or longitudinally spaced apart from each other and the several outlets also being radially or longitudinally spaced apart from each other. In the exemplary embodiment illustrated in FIG. 3, the plurality of injection hole pairs are spaced longitudinally or radially apart from each other for collectively channeling the cooling air 32 into the plenum 34. The plenum 34 is therefore provided with the cooling air 32 solely through the injection holes 38 and is otherwise not disposed in flow communication with any of the flow channels 26. Each of the injection holes 38 is aligned so that the cooling air jets discharged therefrom collide centrally in the plenum 34 generally equidistantly between the internal wall 36 and the sidewall 18.

As shown in FIG. 3 and also in FIG. 2, the injection hole pairs are preferably coplanar with each other and may be coplanar with the respective film cooling holes 40 as shown for the exemplary plenums 34, 34*c*, and 34*d*. Or the injection hole pairs 38 may be askew or non-planar with the film cooling holes 40 as shown for the plenum 34*b*.

In the preferred embodiment, the film cooling holes 40 are arranged in diverging pairs with the inlets thereof being longitudinally spaced apart from each other in the plenum 34, and the outlets thereof also being longitudinally spaced apart from each other on the outer surface of the sidewall 18, with the outlet spacing being greater than the inlet spacing to effect the divergence thereof. Respective ones of the injection holes 38 and the film cooling holes 40 in laterally adjacent pairs are preferably coaxially aligned so that the cooling air jets collide at a crossing point equidistantly between the internal wall 36 and the sidewall 18 inside the plenum 34. In this way, the cooling air jets 32 are discharged from each of the injection holes 38 directly in line with the corresponding one of the film cooling holes 40, with adjacent jets also colliding inside the plenum 34 for enhanced cooling effectiveness inside the plenum 34 itself as well as in the film cooling boundary layer formed from the film cooling holes 40.

This arrangement also provides a significant advantage in the manufacturing of the airfoil 14. The airfoil 14 may be normally cast to provide the various flow channels 26, internal walls 36, and plenums 34 therein. And then, a conventional laser drill 42 as illustrated schematically in FIG. 3 may be used to form both sets of the injection holes 38 and film cooling holes 40 since the laser beam propagates inwardly from the outer surface of the sidewall 18 to first form a film cooling hole 40 and then propagate through the plenum 34 to then form the corresponding injection hole 38 in one drilling operation. Where the injection holes 38 may be large enough for casting, they may be cast if desired. For example, the askew injection holes 38 and film cooling holes 40 associated with the plenum 34*b* on the suction sidewall 20 of the airfoil illustrated in FIG. 2 would be manufactured by casting.

As shown in FIG. 2, the injection holes 38 and pressure regulating plenum 34 may be formed on one or both of the pressure and suction sidewalls 18, 20 of the airfoil 14 as desired for effecting improved film cooling. The plenum 34 may take any suitable configuration such as the circular or oblong configurations illustrated in FIG. 2 and may be suitably sized for providing the required amount of pressure regulation for the film cooling holes 40 being fed thereby.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. A gas turbine engine airfoil comprising:

first and second sidewalls joined together at opposite leading and trailing edges and spaced apart from each other therebetween to define at least one internal flow channel extending longitudinally from a root to a tip of said airfoil for channeling cooling air therein to cool said airfoil;

a plenum defined by an inner surface of said first sidewall and by an internal wall adjoining said flow channel;

a pair of injection holes extending through said internal wall to feed said cooling air into said plenum;

a plurality of film cooling holes extending through said first sidewall in flow communication with said plenum for channeling said cooling air in a film along an outer surface of said first sidewall to effect film cooling; and said injection holes being aligned to converge toward each other so that cooling air jets discharged therefrom collide with each other inside said plenum to reduce pressure thereof.

2. An airfoil according to claim 1 wherein each of said injection holes has an inlet disposed in flow communication with said flow channel, and an outlet disposed in flow communication with said plenum, and said outlets are spaced longitudinally apart from each other.

3. An airfoil according to claim 2 further comprising a plurality of said injection hole pairs spaced longitudinally apart from each other for collectively channeling said cooling air into said plenum.

4. An airfoil according to claim 3 wherein each of said injection hole pairs is aligned so that said cooling air jets therefrom collide centrally in said plenum.

5. An airfoil according to claim 3 wherein said injection hole pairs are coplanar.

6. An airfoil according to claim 3 wherein said injection hole pairs are non-planar with said film cooling holes.

7. An airfoil according to claim 3 wherein said injection hole pairs are coplanar with said film cooling holes.

8. An airfoil according to claim 7 wherein said film cooling holes are arranged in diverging pairs.

9. An airfoil according to claim 8 wherein respective ones of said injection holes and said film cooling holes in adjacent pairs thereof are coaxially aligned so that said cooling air jets collide at a crossing point therebetween inside said plenum.

10. An airfoil according to claim 3 wherein said first sidewall is a pressure side of said airfoil.

11. An airfoil according to claim 3 wherein said first sidewall is a suction side of said airfoil.

* * * * *